US007597496B2

(12) United States Patent
Dubinski

(10) Patent No.: US 7,597,496 B2
(45) Date of Patent: Oct. 6, 2009

(54) SCENT ACTIVATED, MEMORY ENHANCING MEMORY STICK SYSTEM

(76) Inventor: Jonathan B. Dubinski, 43 Waters Edge, Sparta, NJ (US) 07871

( * ) Notice: Subject to any disclaimer, the term of this patent is extended or adjusted under 35 U.S.C. 154(b) by 165 days.

(21) Appl. No.: 11/435,193

(22) Filed: May 16, 2006

(65) Prior Publication Data

US 2007/0269256 A1 Nov. 22, 2007

(51) Int. Cl.
*B43K 5/00* (2006.01)

(52) U.S. Cl. ..... 401/195; 401/17; 401/23; 401/198

(58) Field of Classification Search ..... 401/195, 401/35, 34, 17, 198, 199, 23
See application file for complete search history.

(56) References Cited

U.S. PATENT DOCUMENTS

| | | | | |
|---|---|---|---|---|
| 3,888,416 | A | 6/1975 | Lin | 239/34 |
| 4,244,525 | A | 1/1981 | Manna | 239/289 |
| 4,728,212 | A | 3/1988 | Spector | 401/88 |
| D295,537 | S | 5/1988 | Davidson et al. | D19/43 |
| 5,938,359 | A | 8/1999 | Kim | 401/195 |
| 6,004,057 | A * | 12/1999 | Fulop | 401/195 |
| 6,454,842 | B1 * | 9/2002 | Vernardakis et al. | 106/31.02 |
| 6,491,464 | B1 | 12/2002 | Young | 401/35 |
| 6,899,486 | B2 * | 5/2005 | Wetzel et al. | 401/195 |
| 6,921,223 | B2 | 7/2005 | Marschand | 401/17 |
| 2004/0258455 | A1 | 12/2004 | Brunetti | 401/195 |
| 2005/0074271 | A1 | 4/2005 | Kageyama et al. | 401/195 |
| 2005/0095054 | A1 | 5/2005 | Canale | 401/195 |
| 2006/0108739 | A1 * | 5/2006 | Lutz | 273/292 |
| 2006/0246265 | A1 * | 11/2006 | Rogers et al. | 428/195.1 |
| 2007/0020033 | A1 * | 1/2007 | Walsh | 401/195 |

FOREIGN PATENT DOCUMENTS

| | | | |
|---|---|---|---|
| GB | 2252941 | | 8/1992 |
| JP | 2003105244 | A * | 4/2003 |
| JP | 2003136889 | | 5/2003 |
| JP | 2004306335 | | 11/2004 |
| JP | 2003136889 | | 5/2005 |
| JP | 07290889 | | 11/2007 |
| JP | 2003105244 | | 4/2009 |

OTHER PUBLICATIONS http://www.shopping.discovery.com/product-60278.html—Essential Oils Aromatherapy Pen.

(Continued)

*Primary Examiner*—David J Walczak
(74) *Attorney, Agent, or Firm*—Ernest D. Buff & Associates; Ernest D. Buff; Aniket A. Patel

(57) ABSTRACT

A highlighter marker with a unique scent. The marker is used to highlight printed or written textual material. During the highlighting event, the unique scent evaporates from the ink. A memory link is thereby established between the unique scent and the highlighting event. Subsequently, when the cap of the highlighter marker is opened, the unique scent of the highlighter ink is detected, triggering recall of the highlighted text. A memory aid is thereby provided, which enhances the remembrance of previously highlighted material.

10 Claims, 1 Drawing Sheet

OTHER PUBLICATIONS http://www.shaneland.trustpass.alibaba.com/product/11361438/Aroma_Ballpointpen.html—Aroma Ballpoint Pen.

http://www.gunthergifts.com/wagswisjewpe.html—Wagner Swiss Aromatherapy.

http://www.adsources.com/PENS/COMMA/Aroma.html—Aromatherapy & Ballpoint Pen Combo.

http://www.computergear.com/swisarpen.html—De-stress while you work.

http://www.shopping.discovery.com/product-60278.html—Essential Oils Aromatherapy Pen, 2006.

http://www.shaneland.trustpass.alibaba.com/product/11361438/Aroma_Ballpointpen.html—Aroma Ballpoint Pen, 2006.

http://www.gunthergifts.com/wagswisjewpe.html—Wagner Swiss Aromatherapy, 2006.

http://www.adsources.com/PENS/COMM/Aroma.html—Aromatherapy & Ballpoint Pen Combo, 2006.

http://www.computergear.com/swisarpen.html—De-stress while you work, 2006.

* cited by examiner

SCENT ACTIVATED, MEMORY ENHANCING MEMORY STICK SYSTEM

BACKGROUND OF THE INVENTION

1. Field of the Invention

The present invention relates to writing instruments; and more particularly to a highlighter system that emits a unique scent, which can be associated with a specific learning experience to provide linked memories, so that recollection of the experience is triggered by detection of the scent.

2. Description of the Prior Art

Numerous memory aids have been contemplated in the art enabling recollection of specific learning or other events. These aids include for example multiple recitation, loud recitation, wherein the hearing of a specific fact allows easy recall, association with visual patterns and the like. Recent experiments have shown the enormous recall potential of a scent associated memory event. Studies show that scent can aid memory if the same scent is present during the original experience and the occurrence of the scent triggers the memory when one is trying to remember or recall the experience. Triggering the memory by way of sense of smell has been shown to work best with scents that are unfamiliar or unusual in the context of the experience. The effect of scent on learning and memory has been investigated in an experiment that utilized three different ambient odors: osmanthus, peppermint, and pine. Osmanthus was used to see whether there was a difference in performance depending on whether the scent was novel or familiar. Peppermint and pine were used to see whether the appropriateness or inappropriateness of the scent made a difference to memory. In the experiment, subjects were individually shown into a room in which the odor was present. Their attention was called to the scent, and to ensure their attention to the scent, they were given a questionnaire to fill out about the room environment. They were left alone in the room for ten minutes to promote encoding of contextual cues. The experimenter then read out a list of 20 common nouns, pausing after each one for the subject to describe an event that the word reminded them of. Memory for the words was tested 48 hours later. It was found that word recall was best when the novel odor (osmanthus) was present during learning and again at testing. Among the familiar odors, recall was better if the scent was contextually inappropriate (peppermint). The improvement in recall only occurs when the odor is present at both encoding (learning) and retrieval (testing) as discussed in Herz, R. S., "The Effects of Cue Distinctiveness on Odor-Based Context Dependent Memory", Memory and Cognition, 25, 375-380 (1997).

U.S. Pat. No. 3,888,416 to Lin discloses a scented writing instrument. A conventional ballpoint pen is fitted with a plunger activated air-freshening scent dispenser located on the pen's upper portion. The air-freshening scent is delivered to the ink of the ballpoint pen. The scent provided is air freshening similar to fresh out-door air. It is non-specific and is not operable to trigger memory. No disclosure is contained there in concerning a highlighter marker.

U.S. Pat. No. 4,244,525 to Manna discloses a writing instrument having a refillable scent dispenser. This writing instrument has an annular closed bottom chamber surrounding a central recess, which retains the writing instrument, typically a ballpoint pen. The annular chamber contains a scented liquid, which is pumped by activating a plunger. The scent is not mixed with the ink of the writing instrument. The writing instrument is not a highlighter. The scent does not enable memory association with the act of writing, since the writing action is not concurrent with actuation of the plunger and release of the scent.

U.S. Pat. No. 4,728,212 to Spector discloses a novelty writing pen. This novelty writing pen presents the appearance of a fruit (for example, banana) or other familiar object (for example, sausage) having a characteristic odor and the writing ink incorporates a volatile oil or other scent-producing liquid. When the user writes with the pen, the resultant scent exuded from the writing surface suggests the object's odor. When the pen is put to use, this component causes the surface written on by the pen to exude an odor simulating that of the object carried thereby. The pen is shaped in the form a fruit or other familiar object and the ink used in the ball point pen, felt tip pen or fountain pen comprises a volatile odor producing compound that matches the expected odor of the pen shape. The odor is produced by volatilization of the odor from the writing surface as the novelty pen is used. The ink used in the novelty pen is stated to be viscous resembling a ballpoint pen ink. It is unlikely any volatile odor producing composition may be easily mixed. The viscosity requirements for a felt tip pen and a fountain pen differ significantly. The ballpoint pen, felt tip pen or fountain pen is not a highlighter. The odor produced is not said to enhance memory recall of highlighted text.

U.S. Pat. No. 5,938,359 to Kim discloses a writing instrument having a sanitary moistener. The writing instrument comprises an elongated body with a writing tip at one end and a supply of moistening liquid accessible at a location on the body of the instrument. Access is achieved using a finger of the user. The user's finger is thereby moistened to facilitate turning sheets of paper. This two-part device comprises a ballpoint pen bottom section and a moisture pump spray in the upper section, which is used to moisten ones finger thereby facilitate turning of book pages. The upper section does not carry any scent; and scent is not delivered through the ink of the pen. The pen is a ballpoint pen, not a highlight marker.

U.S. Pat. No. 6,491,464 to Young discloses a multi-element pen. The multi-element pen is a pen with twin heads one on top and one at bottom containing at least three separate storage rooms with operating elements suited for writing, correction or marking. The multi-element pen allows the user to use only one pen for writing and correction. The pen has three storage rooms with connected tip elements. The first storage room contains ordinary ink suited for ordinary writing. The second storage room contains a correcting liquid which is an erasing ink. The third storage room contains a special rewriting ink that can easily write on the corrected area. There is no scent delivery system in this multi-element pen. The scent is therefore not deliverable through the ink of a pen.

U.S. Pat. No. 6,921,223 to Marschand discloses a combo pen. The combo pen is a writing instrument adapted to receive a removable auxiliary module. This writing instrument has a tubular body with a first and second end and a writing tip associated with the first end. The writing instrument includes a receptacle integrally formed within the second end and having a retaining portion to engage a removable auxiliary module including a securing portion, the removable auxiliary module being adapted to be secured within the receptacle by the cooperation of the retaining portion and the securing portion. The writing instrument further includes an auxiliary module cap adapted to engage both the second end adjacent to the retaining and securing portions and the first end adjacent to the writing tip. The removable auxiliary module may be a transfer tape dispensing module, a fountain pen including a nib and an ink reservoir, a tape-flag dispenser, fluid dispensing marker such as a highlighter or a data entry tip. The combination pen has two sides. The first side comprises a writing instrument and the second side is adapted to receive a removable auxiliary module selected from a transfer tape dispensing module, a fountain pen including a nib and an ink reservoir, a tape-flag dispenser, a fluid dispensing marker such as a highlighter or a data entry tip. There is no provision for dispensing scent of any kind.

U.S. Design Pat. D295,537 to Davidson discloses an ornamental design for a marking instrument. This marking instrument is a flat pen having on one side a ballpoint pen and on the other side a felt tip marker. The pen depicted by the '537 design patent is not a highlighter.

U.S. Published Patent application 2004/0258455 to Brunetti discloses a combination writing instrument and device for displaying entertainment content. This combination writing instrument and entertainment device has a permanently affixed, laminated scroll, a portion of which is extendible and retractable for conveying content pertaining to entertainment or recreational purposes which is customizable by a user. The laminated scroll/sheet is provided for displaying printed content thereon, e.g., the laminated sheet may be printed with designs and/or written content in the style/form of a greeting card for the express purpose of gift-giving. The greeting card on the laminated sheet may be pre-printed for any occasion and/or be customized by the user/sender for a particular recipient to contain, e.g., unique and customized written material or scents. This is a pen with a rolled up entertainment slip that may contain printed or hand written material comprising poems, scents, and the like. The pen used in this device is not a highlighter. The ink of the pen does not deliver a scent.

U.S. Published Patent application 2005/0074271 to Kageyama et al. discloses a cartridge type stationery product. This cartridge type stationery product includes a body and a cartridge that is attachable to and detachable from the body. The cartridge is capable of being inserted from an opening of the body. A locking groove is formed on the body, and a locking protrusion, which is inserted into the locking groove is formed on the cartridge. The locking groove is constructed by a first groove portion extending in an axial direction from a vicinity of the opening, and a second groove portion extends from the first groove portion to form an angle with the first groove portion. This pen has a ball point tip on one end. The second end of the pen opposes the first end, and is adapted to receive a cartridge. The cartridge may comprise any replaceable and refillable cartridge of a stationery product such as a marker tool, correction, adhesive or fluorescent highlighter tape coating tool. The cartridge is not indicated to contain any form of scent.

U.S. Published Patent application 2005/0095054 to Canale discloses a scented writing instrument. This writing instrument is substantially made of plastic, having a scent impregnated substantially throughout the plastic, thereby affording a long-term release of scent. The scent is added to the polymer that is used to mold the writing instrument. No scent is released from the ink of the pen. The pen is a ballpoint pen, not a highlighter.

Foreign Patent Publication No. GB 2252941 to Sanchez discloses a combined ball-point pen and spray device. The combined ball-point pen and spray device comprises a tubular body having first and second chambers separated by a wall, the first chamber having a ball-point and ink supply and the second chamber housing a reciprocating pump for expelling liquid, such as perfume, therein by means of a push button. The push button nozzle includes a three-channel spiral pathway for atomizing the spray liquid. This is a ballpoint pen on one side with a perfume spray atomizer on the other side. The pen is not a highlighter. The perfume is not delivered through the ink.

Foreign Patent Publication No. JP 07290889 to Umeda discloses a carrying article provided with auxiliary emitting aroma. The auxiliary article emits an aroma, especially an aroma for preventing becoming sleepy or an aroma providing a tranquilizing effect. The article is attached on or combined with a wiring tool such as an eraser, a pencil, a sharp pencil, a fountain pen, a ball pen and a felt-tip pen. The article carried as an ornamental article such as a ring, a wrist ring, a pendant and a bracelet. The aroma article is also attached to a pen. The ink of the pen does not deliver the aroma.

Foreign Patent Publication No. JP 2003105244 to Shibuya et al. discloses a marking pen. The ink of the pen contains essential oil in the range of 0.5 to 3%. The pen is not indicated to be a highlighter. The scent of the essential oil is recognized by the writer. The scent is not indicated to be a memory enhancing agent.

Foreign Patent Publication No. JP 2003136889 to Oba et al. discloses a writing tool. The writing tool has a ballpoint pen on one end a felt tip marker. This is not a highlighter. There is no scent in the inks used.

Foreign Patent Publication No. JP 2004306335 to Tajima et al. discloses a sweet smelling type writing utensil. This is a ballpoint pen with a sweet smelling dispenser on the other end. A battery powered fan drives and sheds the smell. The pen is a ballpoint pen, not a highlighter. The ink does not contain the sweet smelling compound.

Internet publication Essential Oils Aromatherapy Pen at http://shopping.discovery.com/product-60278.html discloses a pen that combines a high-end writing instrument with the benefits of aromatherapy. One end of the pen is a smooth writing pen. The other end of the pen includes a removable lavender aromatherapy cartridge. When the cap of the pen is twisted off, lavender aromatherapy oils are released. The pure Swiss, essential lavender oils relax and calm the mind. The pen has a matte purple lacquer body with chrome-plated accents. The aromatherapy cartridges are interchangeable. The pen takes the edge off the stress of work by simply applying the essential lavender oils to pulse points and taking a deep breath to feel the slipping away of stress slip. The essential oils are delivered separate from the ink delivered from the pen. The pen is not a highlighter. The essential oil is not indicated to enhance memory.

Internet publication aroma ball pen at http://shaneland.trustpass.alibaba.com/product/113614381/Aroma-_Ballpointpen.html discloses a ballpoint pen that contains some herbal oils, which are extracted from 100% natural herbs to deliver the essence of the aroma. Herbal oils include Lavender oil which calms, releases, and balances strong emotions such as frustration, irritability, nervous anxiety, panic, hysteria and insomnia. Lavender oil also appears to cleanse and soothe the heart, allowing for a release of anger, the emotion which so often is cause for severe depression. *Rosemary* essential oil improves confidence, perception, creativity, and helps balance mind and body. *Rosemary* essential oil may prevent dark thoughts and nightmares and can enhance remembrance of good dreams. *Rosemary* (*rosemary officinalis*) is good for mental strain, exhaustion, and lethargy. The device disclosed is a ballpoint pen, not a highlighter. The herbal oil is not released along with the ink of the ballpoint pen. The herbal oil is not indicated to enhance memory.

Internet publication Wagner Swissjewel Jewel Pen with Aromatherapy at http://www.gunthergifts.com/wagswisjewpe.html discloses a stylish and functional pen offering the benefits of Swiss aromatherapy. The jewel pen is available in seven colors with aromatherapy options including lavender, ginger, rose, grapefruit blend, mint blend, eucalyptus blend and orange blossom blend. Each set includes a smooth writing pen, a glass jewel STIK containing a blend of pure Swiss essential oils, and a genuine leather pen-glove adding glamour & protection. The pen ink does not release the aromatherapy ingredients, but is released separately. The aromatherapy is a feel good agent and is not indicated to enhance memory. This device is a pen, not a highlighter.

Internet publication Aromatherapy & Ballpoint Pen Combo at http://www.adsources.com/PENS/COMM/Aroma.htm discloses aromatherapy, the use of essential oils distilled from plants flowers, trees & herbs to achieve health, vitality & rejuvenation of the body, mind and spirit in combination with a pen, which may have 1 to 3 color imprints. The aroma is selected from Awake or Clear Mind proprietary fragrances. This is a combination of aromatherapy dispenser and a pen. The pen disclosed is not a highlighter. The aroma is not dispensed in the ink of the pen. The aromatherapy is a feel-good agent, and is not indicated to enhance memory.

Internet publication De-stress while you work at http://www.computergear.com/swisarpen.html discloses a Swiss-made precision roller ball pen with built-in aromatherapy. The cap of the roller pen is removed and the fragrance is dapped on the wrist, neck or pulse point to feel the stress drain. An interchangeable roller ball cartridge contains natural plant oils that cultivate the spirit of healing and well-being. The fragrance is chosen from ginger red, orange blossom white, mint green, eucalyptus blue, grapefruit yellow, lavender purple, or rose pink. Each set comes gift-boxed with pen, fragrance, ink refill and leather carrying sleeve. This is a roller pen and the fragrance is not delivered together with the pen ink. The pen is not a highlighter. The fragrance is a feel-good agent and is not indicated to enhance memory.

Notwithstanding the efforts of prior art workers to incorporate scents in fountain pens, ball pens and other writing instruments, there exists a need in the art for a system wherein a unique scent is generated by a highlighting marker during a learning event, so that the unique scent delivered anchors the memory of the highlighting, learning event, thereby enabling facts memorized during the event to be recalled by the user at a subsequent point in time when the highlighting marker ink, incorporating the unique scent, is detected.

SUMMARY OF THE INVENTION

The present invention provides a memory stick comprising a specially designed, highlighter pen constituted with ink adapted to emit a unique unusual scent. When the highlighter is used to mark a specific portion of test during a learning event, the highlighter ink dries slowly, causing evaporation of the ink. The unique scent contained by the ink is thereby delivered to the user, creating a memory link between the highlighting event and the unusual scent. At a later time, when it is desirable that the highlighted be recalled, the user removes the cap from the highlighter. Removal of the highlighter cap enables ink within the highlighter to emit the unique scent, thereby triggering recall of the highlighted text. Several highlighter pens having distinctly different, discrete and unusual scents may be used to link several highlighting events for subsequent recall, since the memory for scent and its association with miscellaneous events is extensive.

Generally stated, the Memory Stick comprises: (i) a highlighter pen comprising a body portion and highlighter portion, the body portion having a highlighter well that contains a highlighter fluid, and the highlighter portion receiving said highlighter fluid from said highlighter well; and (ii) said highlighter fluid comprising a unique scent adapted to establish a memory link with facts learned during the highlighting event, to trigger memory recall during use of the highlighter pen when the scent of the highlighter fluid is detected.

The Memory Stick provides a scent in order to evoke memories to the user. The Memory Stick utilizes a distinct scent so that a user's olfactory senses are engaged when utilizing the Memory Stick. At a later time, the distinct scent becomes operative to facilitate retrieval of information from memory. For example, when the user is studying and highlighting in a textbook with the Memory Stick, the scent of the stick and the information being studied become synergistically associated. Later, for example during an exam, the user is exposed to the highlighter scent so that the information studied is retrieved from memory. Advantageously, the scent enhances the user's ability to recall that which he/she has learned. Countless studies have shown that recall can be enhanced if learning was carried out in the presence of a unique odor and that same odor is encountered at the time of recall.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

Figure 1A:
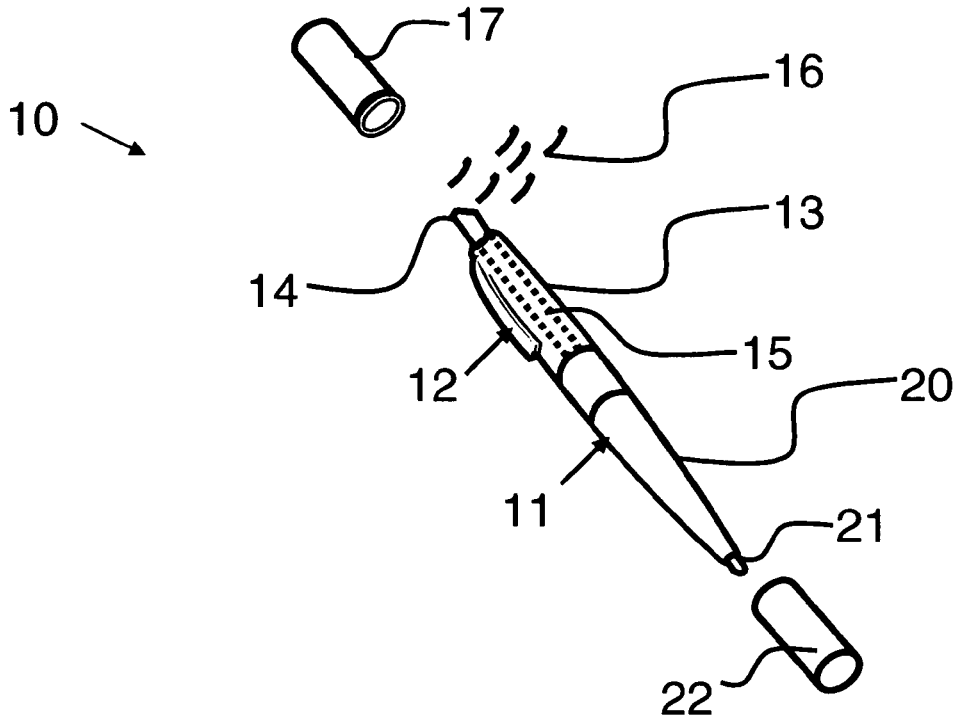
FIG. 1*a* is a schematic diagram of the memory stick with a pen or pencil and highlighter combination.

This invention relates to a Memory Stick System that provides a scent in order to evoke memories to the user. The Memory Stick System utilizes a distinct sent so that a user's olfactory senses are engaged when utilizing the Memory Stick. At a later time, the distinct scent triggers recall of subject matter initially identified using the Memory Stick. The distinct scent is synergistically associated with highlighted subject matter to facilitate retrieval of information from memory. For example, when the user is studying and highlighting in a textbook with the Memory Stick, the scent of the stick and the information being studied become inseparably associated. Later on, for example during an exam, the user is exposed to the highlighter scent, facilitating recall of the information. Advantageously, the scent significantly enhances the user's ability to remember that which he/she has learned. Studies have shown that recall can be enhanced if the learning process is carried out in the presence of a distinct scent and that same scent is presented at the time of recall.

The present invention provides a highlighter that delivers a special scent when the highlighter is used to mark a particular passage. As the highlighter ink dries on the paper, the scent contained in the ink evaporates providing the scent to the user. Three concurrent actions, namely, (i) highlighting a particular textual passage; (ii) memorizing the content of the textual passage; and (iii) the scent emitted by the highlighter ink during the learning process are strongly linked together in the user's memory. Subsequently, detection of the unique scent enables the user to recall the content of the textual passage owing to the existence of the strong memory link.

The key requirements for establishing a recallable memory link are as follows: (i) the ink used in the highlighter must be present in sufficient quantity, and contain an ample concentration of the unique scent composition, so that the scent is perceived by the user when the highlighter cap is removed.

Inks of fountain pens or ballpoint pens are typically not well suited for this purpose, since the quantity of ink applied to the paper during the learning event is too small to facilitate detection of the unique scent.

The highlighter inks are of varied compositions. Several of these ink compositions contain solvents that are fast drying. These solvent based highlighter inks do not damage printed text but, unfortunately, these solvent containing highlighters smear ink jet printed material. There have been attempts to provide ink jet print smear-resistant highlighter inks. U.S. Published application 20050093949 to Schmid et al. discloses ink compositions for use in highlighter markers and associated methods. These inks contain an acid buffered liquid vehicle of water, diethylene glycol, polyethylene glycol, glycerol, dipropylene glycol, propylene glycol, polypropylene glycol, 2-pyrrolidinone, and mixtures thereof. The colorant dye used is Basic Yellow 40, Acid Yellow 23, Acid Red 52, Acid Blue 9 or combinations thereof. In any case, the scent used must be easily incorporated in the highlighter ink and should evaporate at the same rate or at a grater rate than the liquid vehicle or solvent used in the highlighter ink. The scent compositions are generally very effective in very small concentrations due to extreme sensitivity of the olfactory system and this incorporation of unusual scents in the highlighter ink is not a problem. A number of unusual scents may be selected from synthetic or natural scents or combinations thereof. Natural scents may include jasmine, rose, cinnamon, curry, lemon, orange, apple, bitter sweet, coriander, cloves, nutmeg and many others. Synthetic scents involve too many available compositions. Typical concentration of scent in the highlighter ink composition ranges from 0.1% to 30%.

The ink used in the highlighter carries the desired scent that invokes the memory of a user that has highlighted a portion of the text and experienced the scent as the highlighter ink dries. A memory link is thereby created between what is highlighted and the scent perceived. At a later time when the user unscrews the back cap of the highlighter, the scent entrained in the highlighter ink triggers the memory of the highlighted text, providing a recapitulation of the text data selected by the user. The highlighter may be attached to a pen, as detailed in the first embodiment outlined in FIG. 1*a* below, or may be provided as a stand alone highlighter as is the case for the second embodiment outlined in FIG. 1*b* below.

Figure 1B:
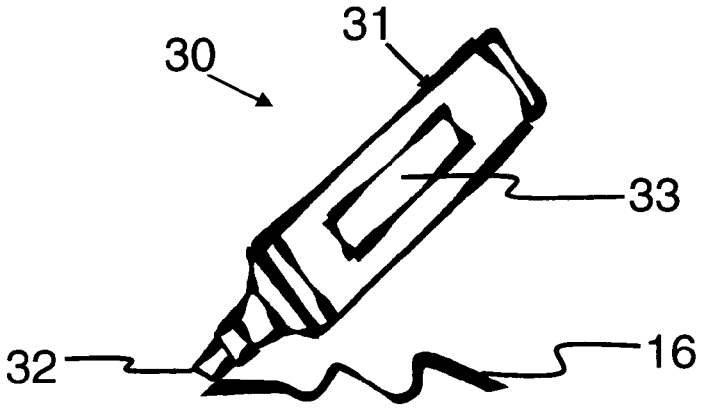
FIG. 1*b* depicts a memory sick highlighter.

FIGS. 1*a* and 1*b* illustrate schematic views of the Memory Stick, with FIG. 1*a* showing generally at 20 the Memory Stick as a pen/pencil and highlighter combination; and FIG. 1*b* showing generally at 30 the Memory Stick as a highlighter solely. The Memory Stick shown at 10 comprises a pen—highlighter combination 11. The pen—highlighter combination 11 comprises a highlighter pen portion 12 having a body portion 13 and highlighter portion 14 in the form of a felt tip. Body portion 13 has a highlighter well 15 containing highlighter fluid 16 therein. Highlighter portion 14 receives the highlighter fluid 16 from highlighter well 15 when the user is utilizing the pen—highlighter 11. The highlighter fluid 16 from highlighter well 15 comprises a scent for inducing memory of the user when the user is utilizing the highlighter pen portion 12. When the user smells the scent from the pen—highlighter 11 the user's memory is triggered so that the user can retrieve information at a later time. The pen—highlighter 11 highlighter portion 14, equipped with a distinct scent, is used by the user during studying; while at the same time, pen—highlighter 11 provides a pen body portion 20 with pen tip 21 and pen cap 22 to be utilized during an exam with the highlighter cap 17 removed in order to release the scent and evoke the user's memory. FIG. 1*b* illustrates the Memory Stick as a highlighter 30, having body portion 31 and a highlighter portion 32. Body portion 31 comprises a highlighter well 33 containing highlighter fluid 16 appointed with a distinct scent.

The key components of the Memory Stick System comprise, in combination, the features set forth below:

1) A Memory Stick having a highlighter portion;
2) said highlighter portion being adapted for use in highlighting a text that is appointed to be remembered;
3) the highlighter portion containing a brightly colored transparent ink;
4) the transparent ink incorporating a distinct perfume scent;
5) the distinct perfume evaporating as the ink dries on a highlighted text; and
6) the action of selecting textual material being associated with the scent of the evaporated perfume;

whereby removal of the highlighter cap disseminates scent from the perfume entrained in the highlighter ink, facilitating recall of the highlighted text.

The first embodiment is used to create the memory stick highlighter attached to a fountain pen, ballpoint pen or a pencil. This provides a convenient combination of writing instruments wherein notes can be readily taken and portions of printed text or written text may be highlighted using the memory stick to create a memory link.

The second embodiment provides a stand-alone highlighter memory stick. It is clear that a number of highlighter memory sticks may be produced with different unique scents which, in turn, can be used to establish memory links with different highlighting events. This is readily accomplished by selecting different highlighter color pens to mark different areas of printed or written text.

Having thus described the invention in rather full detail, it will be understood that such detail need not be strictly adhered to, but that additional changes and modifications may suggest themselves to one skilled in the art, all falling within the scope of the invention as defined by the subjoined claims

What is claimed is:

1. A method of using a highlighter marker comprising the steps of:

a) removing a cap that covers an ink containing, scent emitting portion of the highlighter marker;
b) said ink comprising a unique scent;
c) delivering said highlighter ink to a paper with printed or written text through a highlighter felt tip during a highlighting operation performed by a user whereby, during said highlighting operation, said ink is delivered to portions of text selected by the user to be remembered;
d) permitting said highlighter ink to dry on said paper, thereby evaporating said scent whereby, said evaporation of said scent is operative to establish a memory link wherein said user associates the evaporated scent with said highlighted text;
e) removing said highlighter cap, subsequent to said highlighting operation when memory recollection is desired, causing emission of said unique scent which, upon detection, triggers said user's recall of said text.

2. A method as recited by claim 1, wherein the highlighter ink contains a colorant dye.

3. A method as recited by claim 2, wherein the highlighter ink colorant dye is selected from the group consisting of Basic Yellow 40, Acid Yellow 23, Acid Red 52, Acid Blue 9 or combinations thereof.

4. A method as recited by claim 1, wherein the unique scent is a member selected from the group consisting of natural scents, synthetic scents and combinations thereof.

5. A method as recited by claim 4, wherein the highlighter ink unique natural scent is a member selected from the group consisting of jasmine, rose, cinnamon, curry, lemon, orange, apple, bitter sweet, coriander, cloves, nutmeg and combinations thereof.

6. A method as recited by claim 1, wherein said marker is associated with a member selected from the group consisting of a fountain pen, a ballpoint pen or a pencil.

7. A method as recited by claim 1, wherein the concentration of the unique scent in said highlighter ink ranges from about 0.1% to 30%.

8. A method as recited in claim 7, where the concentration of the unique scent ranges from about 0.1% to less than 0.5%.

9. A method as recited in claim 7, where the concentration of the unique scent ranges from more than 3% to about 30%.

10. A method as recited by claim 1 wherein said ink is brightly colored and transparent.

* * * * *